US011670212B2

(12) United States Patent
Lee et al.

(10) Patent No.: US 11,670,212 B2
(45) Date of Patent: Jun. 6, 2023

(54) IMAGE STICKING COMPENSATION DEVICE AND DISPLAY DEVICE HAVING THE SAME

(71) Applicant: SAMSUNG DISPLAY CO., LTD., Yongin-si (KR)

(72) Inventors: Jae Hoon Lee, Yongin-si (KR); Seung Ho Park, Yongin-si (KR); Jin Ho Lee, Yongin-si (KR); Sang Myeon Han, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/523,218

(22) Filed: Nov. 10, 2021

(65) Prior Publication Data

US 2022/0223092 A1 Jul. 14, 2022

(30) Foreign Application Priority Data

Jan. 8, 2021 (KR) ..... 10-2021-0002881

(51) Int. Cl.
*G09G 3/20* (2006.01)

(52) U.S. Cl.
CPC ... *G09G 3/2007* (2013.01); *G09G 2300/0842* (2013.01); *G09G 2310/08* (2013.01); *G09G 2320/0257* (2013.01); *G09G 2320/048* (2013.01)

(58) Field of Classification Search
None
See application file for complete search history.

(56) References Cited

U.S. PATENT DOCUMENTS

| | | | | |
|---|---|---|---|---|
| 10,078,981 | B2 | 9/2018 | Chung et al. | |
| 10,262,582 | B2 | 4/2019 | Han | |
| 10,565,953 | B2 | 2/2020 | Kim et al. | |
| 10,586,507 | B2 | 3/2020 | Lee et al. | |
| 2016/0379550 | A1* | 12/2016 | Jiang | G09G 3/3208 345/520 |
| 2017/0213493 | A1* | 7/2017 | Han | G09G 3/3208 |
| 2020/0349884 | A1* | 11/2020 | Lai | G09G 3/3208 |

FOREIGN PATENT DOCUMENTS

| | | | |
|---|---|---|---|
| KR | 1020150101506 | A | 9/2015 |
| KR | 1020170088452 | A | 8/2017 |
| KR | 1020180049332 | A | 5/2018 |
| KR | 1020180123608 | A | 11/2018 |

* cited by examiner

*Primary Examiner* — Matthew Yeung
(74) *Attorney, Agent, or Firm* — Cantor Colburn LLP

(57) ABSTRACT

An image sticking compensation device includes: a deterioration calculator which calculates deterioration data of a current frame based on input image data and sensing frequency information which are received from a timing controller; an accumulator which accumulates the deterioration data and generates age data in which the deterioration data is accumulated; and a compensator which determines a grayscale compensation value corresponding to the age data and an input grayscale value of the input image data, and outputs age compensation data by applying the grayscale compensation value to the input image data. The sensing frequency information includes a frequency of the current frame, and the deterioration data varies in accordance with the frequency of the current frame.

18 Claims, 12 Drawing Sheets

IMAGE STICKING COMPENSATION DEVICE AND DISPLAY DEVICE HAVING THE SAME

The application claims priority to Korean Patent Application No. 10-2021-0002881, filed Jan. 8, 2021, and all the benefits accruing therefrom under 35 U.S.C. § 119, the content of which in its entirety is herein incorporated by reference.

BACKGROUND

1. Field

Various embodiments of the present disclosure generally relate to an image sticking compensation device and a display device having the image sticking compensation device, and more particularly to a display device which varies a driving frequency (or a frame rate).

2. Discussion

A display device includes a pixel component including a plurality of pixels and a driver for driving the pixel component. The driver displays an image on the pixel component using image signals received from an external graphics processor. The graphics processor may generate image signals by rendering source data, and may vary a rendering time during which image signals corresponding to one frame are generated, depending on the type or characteristics of an image. The driver may vary a frame rate in accordance with the rendering time.

A pixel may include a pixel circuit, having a plurality of transistors and capacitors, and a light-emitting element. When a scan signal is supplied from a scan line, the pixel circuit may be supplied with a data voltage from a data line, and may supply the current of the driving transistor depending on the data voltage to the light-emitting element. The light-emitting element may emit light with intensity corresponding to the current of the driving transistor.

The display device may accumulate age or lifetime values (or degrees of deterioration) for respective pixels using image sticking compensation technology, and may compensate for deterioration degrees for respective pixels based on the accumulated age values, thus canceling image sticking (i.e., an afterimage). For example, the display device may accumulate the deterioration degrees based on currents flowing through respective pixels in each frame, the emission times of respective pixels, the temperature of a display panel, or the like.

When the deterioration degrees are accumulated for respective pixels, weights corresponding to frequencies may be taken into consideration. The frequency may be measured by counting a scan start signal. That is, the emission time of each pixel may be calculated by multiplying the number of times that a scan start signal is supplied by the pixel emission time in each frame.

SUMMARY

However, when the frame rate varies, the emission time of the corresponding pixel (or a blank period between active periods) also varies, and thus only counting a scan start signal may not reflect the actual emission time of the corresponding pixel. Due thereto, a problem may arise in that the deterioration degree of each pixel cannot desirably take into consideration.

Various embodiments of the present disclosure are directed to technology for compensating for the deterioration degree of a pixel by reflecting an actual emission time of the pixel in a display device in which a driving frequency varies.

Aspects of the present disclosure are not limited to the above-described aspects, and other aspects, not described here, may be clearly understood by those skilled in the art from the following description.

An embodiment of the present disclosure may provide for an image sticking compensation device. The image sticking compensation device includes: a deterioration calculator which calculates deterioration data of a current frame based on input image data and sensing frequency information which are received from a timing controller; an accumulator which accumulates the deterioration data and generates age data in which the deterioration data is accumulated, and a compensator which determines a gray scale compensation value corresponding to the age data and an input grayscale value of the input image data, and outputs age compensation data by applying the grayscale compensation value to the input image data. The sensing frequency information includes a frequency of the current frame, and the deterioration data varies in accordance with the frequency of the current frame.

The timing controller may include a receiver which receives an image signal and a control signal from an external system and restores a data enable signal and a main clock signal from the control signal, and an image signal processor which converts the image signal into image data and outputs the image data.

The timing controller may further include a counter which outputs a blank count signal using the data enable signal and the main clock signal, and a transmitter which outputs the input image data using the image data and outputs the sensing frequency information using the blank count signal.

The counter may be configured to perform a count operation in synchronization with the main clock signal from a time point at which the data enable signal makes a transition to a low level, to repeat the count operation in synchronization with the main clock signal while the data enable signal is maintained at the low level, and to transmit the blank count signal to the transmitter when the data enable signal makes a transition from the low level to a high level.

The deterioration calculator may calculate the deterioration data using the following Equation (1):

$$\text{deterioration data of current frame} = \text{reference age value} \times (\text{reference frequency})/(\text{sensing frequency}) \quad (1)$$

where the reference frequency is a frequency in normal frames other than a frame to which a variable frequency is applied, the reference age value is a value corresponding to to a time during which a pixel emits light during one frame driven at the reference frequency, and the sensing frequency is a frequency of the current frame.

The compensator may include: a memory including a plurality of lookup tables in which compensation values, which correspond to a plurality of preset age values corresponding to the age data and respective display grayscale values that are capable of being implemented by a display panel, are set; a compensation value determiner which determines the grayscale compensation value corresponding to the age data from the lookup tables; and a compensation data output circuit which outputs the age compensation data based on the grayscale compensation value.

The lookup tables may be set depending on an emission color of pixels included in the display panel and a preset temperature of the display panel, respectively.

The compensation value determiner may select one lookup table from among the lookup tables based on a current temperature of the display panel and the emission color.

The deterioration calculator may calculate the deterioration data by applying a deterioration weight.

The deterioration weight may include at least one of a position weight corresponding to a position of each pixel included in the display panel, a luminance weight corresponding to a luminance, an emission duty weight corresponding to an emission duty, and a temperature weight corresponding to a current temperature of the display panel.

The deterioration calculator may calculate the position weight, the luminance weight, and the emission duty weight based on the input image data.

The deterioration calculator may calculate the temperature weight based on an external temperature detector or a temperature prediction algorithm.

An embodiment of the present disclosure may provide for a display device. The display device includes: a display panel including a plurality of pixels; an image sticking compensator which outputs age compensation data based on input image data and sensing frequency information; a scan driver which provides a scan signal to the display panel; a data driver which provides a data signal corresponding to the age compensation data to the display panel; and a timing controller which controls driving of the scan driver and the data driver. The image sticking compensator includes: a deterioration calculator which calculates deterioration data of a current frame based on the input image data and the sensing frequency information which are received from the timing controller; an accumulator which accumulates the deterioration data and generates age data in which the deterioration data is accumulated; and a compensator which determines a grayscale compensation value corresponding to the age data and an input grayscale value of the input image data, and outputs the age compensation data by applying the grayscale compensation value to the input image data. The sensing frequency information includes a frequency of the current frame, and the deterioration data varies in accordance with the frequency of the current frame.

The timing controller may include: a receiver which receives an image signal and a control signal from an external system and restores a data enable signal and a main clock signal from the control signal; and an image signal processor which converts the image signal into a data signal and outputs the data signal.

The timing controller may further include: a counter which outputs a blank count signal using the data enable signal and the main clock signal, and a transmitter which outputs the input image data using the data signal and outputs the sensing frequency information using the blank count signal.

The counter may be configured to perform a count operation in synchronization with the main clock signal from a time point at which the data enable signal makes a transition to a low level, to repeat the count operation in synchronization with the main clock signal while the data enable signal is maintained at the low level, and to transmit the blank count signal to the transmitter when the data enable signal makes a transition from the low level to a high level.

The deterioration calculator may include the deterioration data using the following Equation (1):

$$\text{deterioration data of current frame} = \text{reference age value} \times (\text{reference frequency})/(\text{sensing frequency}) \quad (1)$$

where the reference frequency is a frequency in normal frames other than a frame to which a variable frequency is applied, the reference age value is a value corresponding to a time during which a pixel emits light during one frame driven at the reference frequency, and the sensing frequency is a frequency of the current frame.

The compensator may include: a memory including a plurality of lookup tables in which compensation values, which correspond to a plurality of preset age values corresponding to the age data and respective display grayscale values that are capable of being implemented by a display panel, are set; a compensation value determiner which determines the grayscale compensation value corresponding to the age data from the lookup tables, and a compensation data output circuit which outputs the age compensation data based on the grayscale compensation value.

The lookup tables may be set depending on an emission color of pixels included in the display panel and a preset temperature of the display panel, respectively.

The compensation value determiner may select one lookup table from among the lookup tables based on a current temperature of the display panel and the emission color.

DETAILED DESCRIPTION

Figure 1:
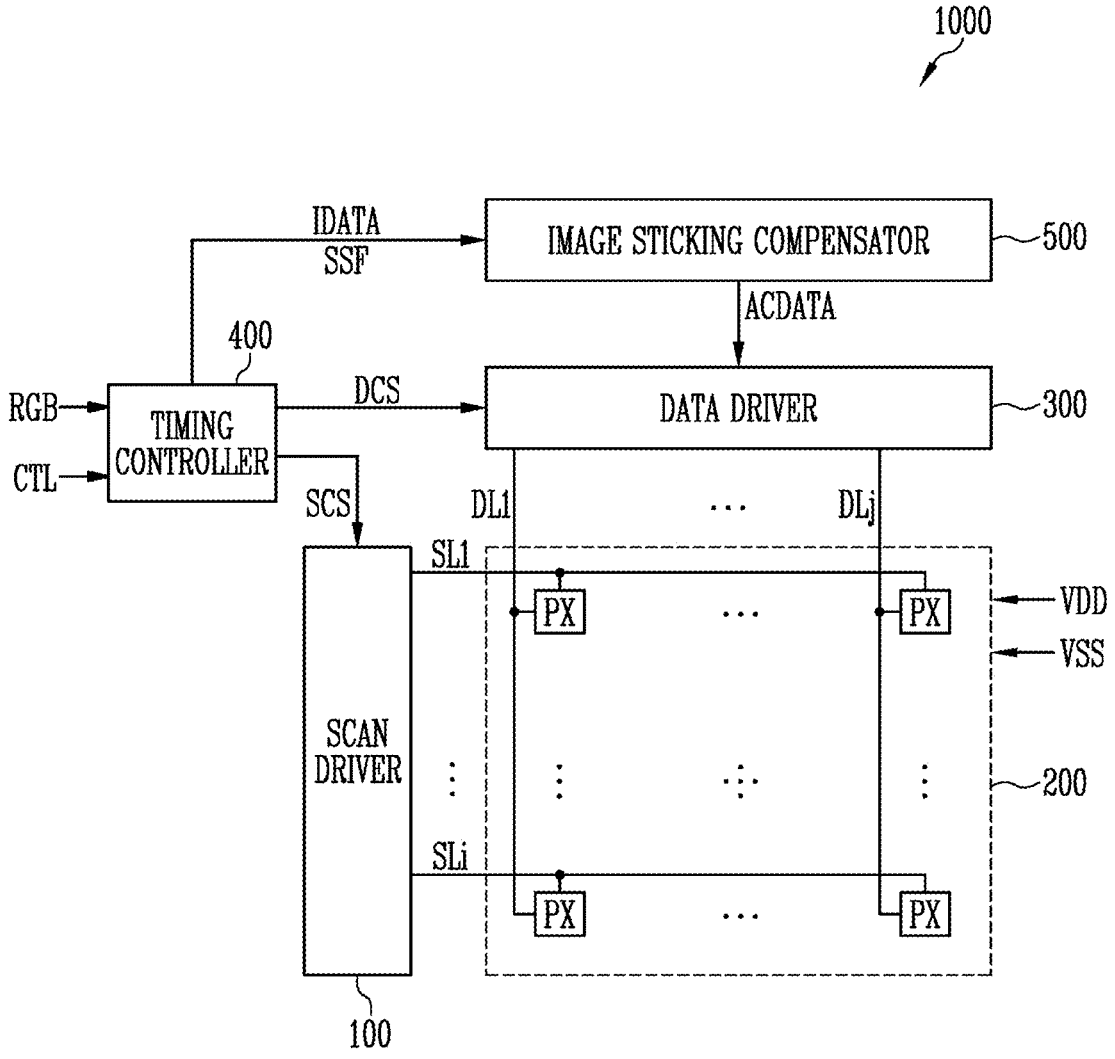
FIG. 1 is a block diagram illustrating a display device according to an embodiment of the present disclosure.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Embodiments of the present disclosure will hereinafter be described in detail with reference to the accompanying drawings. The same reference numerals are used to designate the same or similar components throughout the drawings, and repeated descriptions thereof will be omitted.

Figure 2:
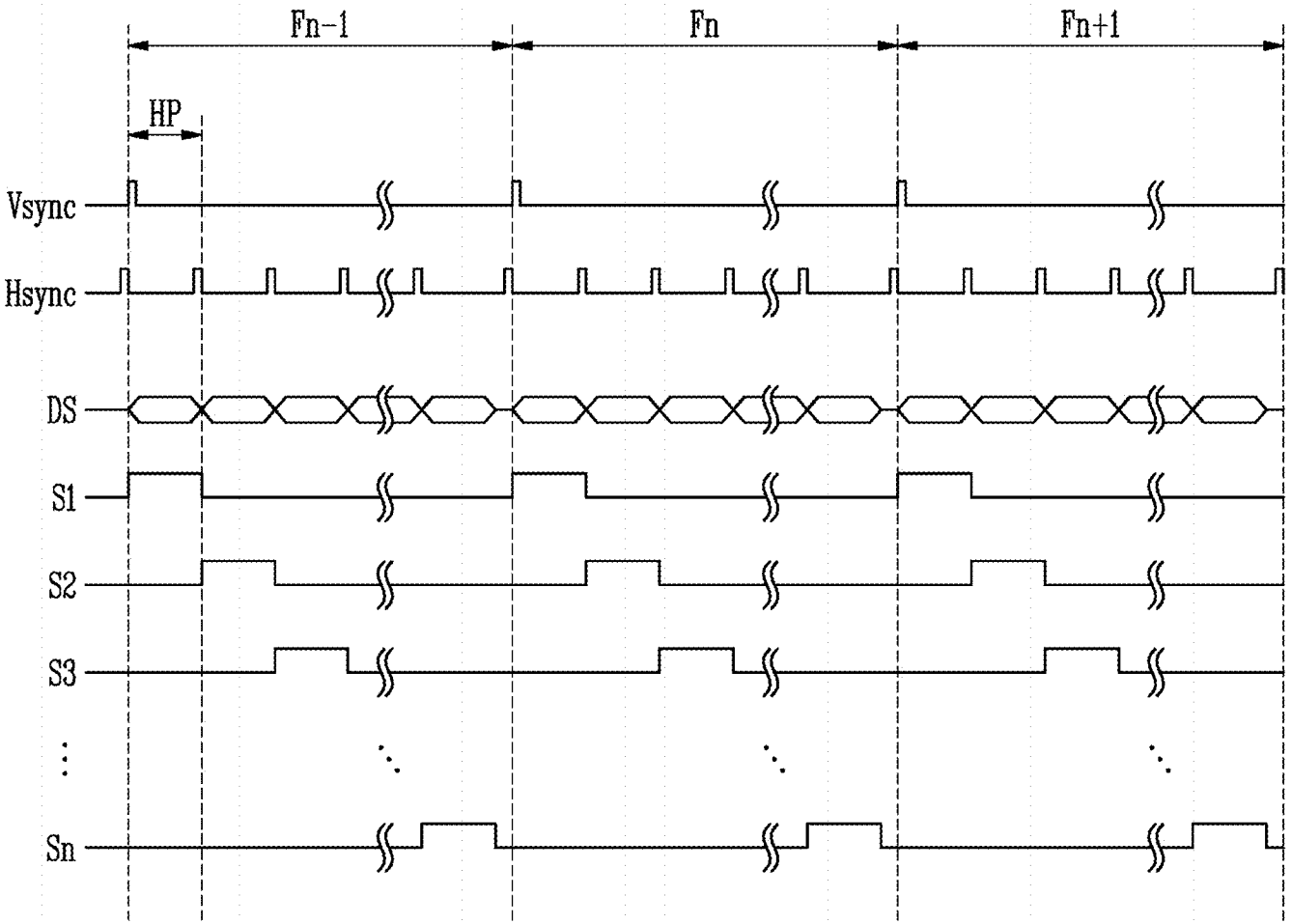
FIG. 2 is a timing diagram illustrating signals of a display device according to an embodiment of the present disclosure.

FIG. 1 is a block diagram illustrating a display device according to an embodiment of the present disclosure. FIG. 2 is a timing diagram illustrating signals of the display device according to an embodiment of the present disclosure.

Referring to FIGS. 1 and 2, a display device 1000 may include a scan driver 100, a display panel 200, a data driver 300, a timing controller 400, and an image sticking compensator 500. Here, the image sticking compensator 500 may be referred to as an "image sticking compensation device".

The display device 1000 may be a flat panel display device, a flexible display device, a curved display device, a foldable display device, or a bendable display device. Also, the display device 1000 may be applied to a transparent display device, a head-mounted display device, a wearable display device, or the like.

The display device 1000 may be implemented as a self-emissive display device including a plurality of self-emissive elements. For example, the display device 1000 may be an organic light-emitting display device including organic light-emitting elements, a display device including inorganic light-emitting elements, or a display device including light-emitting elements in which an inorganic material and an organic material are configured in combination. However, this is only an embodiment, and the display device 1000 according to the invention may be implemented as a liquid crystal display device, a plasma display device, a quantum dot display device, or the like.

In an embodiment, the display device 1000 may be driven such that a period thereof is divided into an active period during which image data is input, and a blank period during which image data is not input, the length of which varies depending on variation in frame rate (frame frequency). (See FIG. 11) The length of the blank period may be adjusted to overcome mismatch between the timing at which frame information is supplied from an external host system (e.g., a graphics processor, an application processor, etc.) and the timing at which the display device 1000 outputs an image frame.

The timing controller 400 may supply input image data IDATA, obtained by rearranging an image signal RGB supplied from an external system, to the image sticking compensator 500.

The timing controller 400 may generate a data driving control signal DCS and a scan driving control signal SCS in response to a control signal CTL supplied from an external system. The data driving control signal DCS generated by the timing controller 400 may be supplied to the data driver 300, and the scan driving control signal SCS may be supplied to the scan driver 100. The control signal CTL may include a vertical synchronization signal Vsync, which is a signal for distinguishing frame periods Fn—1, Fn, and Fn+1 from each other, a horizontal synchronization signal Hsync for distinguishing horizontal periods HP from each other, a data enable signal which is at a high level only during a period in which data is output so as to indicate an area in which data is input, and clock signals.

The data driving control signal DCS may include a source start signal and clock signals. The source start signal may control a time point at which data sampling starts. The clock signals may be used to control a sampling operation.

The scan driving control signal SCS may include a scan start signal and clock signals. The scan start signal may control a first timing of a scan signal. The clock signals may be used to shift the scan start signal.

Further, the timing controller 400 may supply sensing frequency information SSF, which is extracted using the control signal CTL supplied from an external system, to the image sticking compensator 500. The timing controller 400 may divide one frame into an active period and a blank period in response to the control signal CTL. The timing controller 400 may count the length of the blank period, and may generate a count signal. The timing controller 400 may generate the sensing frequency information SSF using the count signal.

The scan driver 100 may receive the scan driving control signal SCS from the timing controller 400. The scan driver 100 supplied with the scan driving control signal SCS may supply scan signals to scan lines SL1 to SLi (where i is a natural number). In accordance with an embodiment, the scan driver 100 may sequentially supply the scan signals to the scan lines SL1 to SLi. When the scan signals are sequentially supplied to the scan lines SL1 to SLi, pixels PX may be selected on a horizontal line basis (or a pixel row basis). That is, pixels PX in the same row may be supplied with the scan signal simultaneously. For this operation, each scan signal may be set to a gate-on voltage (e.g., a logic high level) so that a transistor included in the corresponding pixel PX can be turned on. The timing and waveform at which scan signals are supplied may be set differently depending on the active period, the blank period, or the like.

The image sticking compensator 500 may output age (lifetime) compensation data ACDATA based on the input image data IDATA and the sensing frequency information SSF. In an embodiment, the image sticking compensator 500 may be implemented as a separate application processor ("AP"). In another embodiment, the image sticking compensator 500 may be included in the timing controller 400. In still another embodiment, the image sticking compensator 500 may be included in the data driver 300.

The data driver 300 may provide data signals DS, corresponding to the age compensation data ACDATA, to the pixels PX of the display panel 200 through data lines DL1 to DLj during a display period. The data driver 300 may provide the data signals DS to the display panel 200 in response to the data driving control signal DCS received from the timing controller 400. In an embodiment, the data driver 300 may include a gamma corrector (or a gamma voltage generator) which converts the age compensation data ACDATA into voltages corresponding to the data signals DS.

The data signals DS supplied to the data lines DL1 to DLj may be supplied to the pixels PX selected in response to the scan signals. For this operation, the data driver 300 may supply the data signals DS to the data lines DL1 to DLj so that the data signals DS are synchronized with scan signals.

The display panel 200 includes the pixels PX coupled to the scan lines SL1 to SLi and the data lines DL1 to DLj. The display panel 200 may be supplied with first driving power VDD and second driving power VSS from an external system.

In an embodiment, transistors included in the display device 1000 may be N-type oxide Thin Film Transistors ("TFTs"). For example, such an oxide TFT may be a low-temperature polycrystalline oxide ("LTPO") TFT. However, this is only an example, and N-type transistors according to the invention are not limited thereto. For example, an active pattern (semiconductor layer) included in each transistor may include an inorganic semiconductor (e.g., amorphous silicon or polysilicon), an organic semiconductor, etc.

However, this is only an example, and at least one of the transistors included in the display device 1000 may be replaced with a P-type transistor. For example, the P-type transistor may be a P-channel metal oxide semiconductor ("PMOS") transistor.

Figure 3:
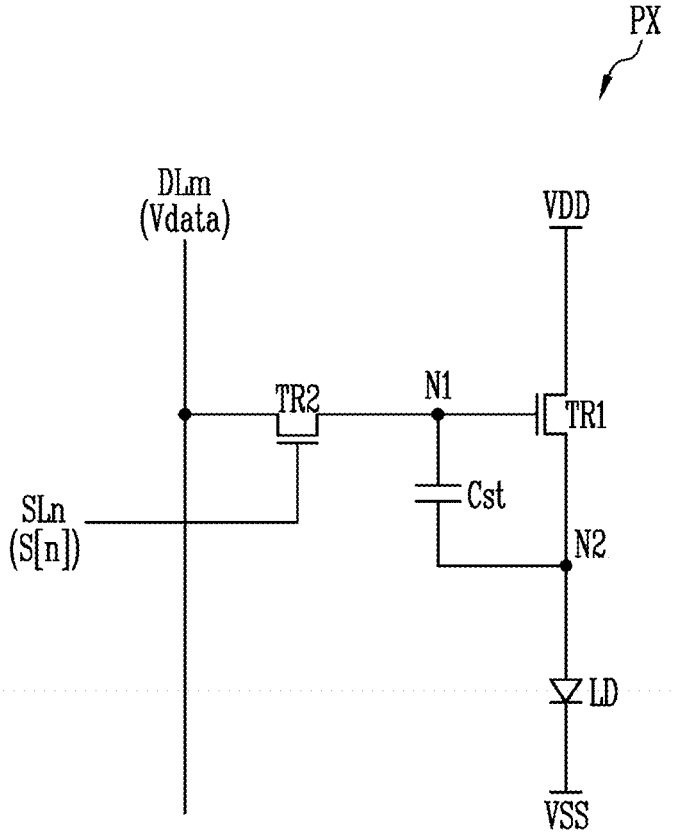
FIG. 3 is a circuit diagram illustrating an example of a pixel included in the display device of FIG. 1.

FIG. 3 is a circuit diagram illustrating an example of a pixel included in the display device of FIG. 1. For convenience of description, a pixel coupled to an n-th scan line SLn and an m-th data line DLm is illustrated (where n and m are natural numbers) in FIG. 3.

Referring to FIG. 3, the pixel PX may include a first transistor TR1 (or a driving transistor), a second transistor TR2, a storage capacitor Cst, and a light-emitting element LD.

A first electrode of the first transistor TR1 may be coupled to a first driving power source VDD, and a second electrode thereof may be coupled to an anode of the light-emitting element LD. A gate electrode of the first transistor TR1 may be coupled to a first node N1. The first transistor TR1 may control the amount of current flowing into the light-emitting element LD in accordance with the voltage of the first node N1.

A first electrode of the second transistor TR2 may be coupled to the data line DLm, and a second electrode thereof may be coupled to the first node N1. A gate electrode of the second transistor TR2 may be coupled to the n-th scan line SLn. When a scan signal S[n] is supplied to the n-th scan line SLn, the second transistor TR2 may be turned on, and may then receive a data signal (i.e., a data voltage Vdata) from the data line DLm and transfer the data signal to the first node N1.

The storage capacitor Cst may be coupled between the first node N1 (i.e., the gate electrode of the first transistor TR1) and the anode electrode of the light-emitting element LD (i.e., the second electrode of the first transistor TR1). The storage capacitor Cst may store the difference between the voltage of the first node N1 and the voltage of the second node N2.

The anode electrode of the light-emitting element LD may be coupled to the second electrode of the first transistor TR1 (i.e., the second node N2), and the cathode electrode of the light-emitting element LD may be coupled to a second driving power source VSS. The light-emitting element LD may generate light with predetermined luminance in accordance with the amount of current supplied from the first transistor TR1. However, in the embodiment of the present disclosure, the pixel PX is not limited to the pixel circuit structure illustrated in FIG. 3, and, for example, a well-known pixel circuit including an additional transistor and an additional capacitor, may be used.

Figure 4:
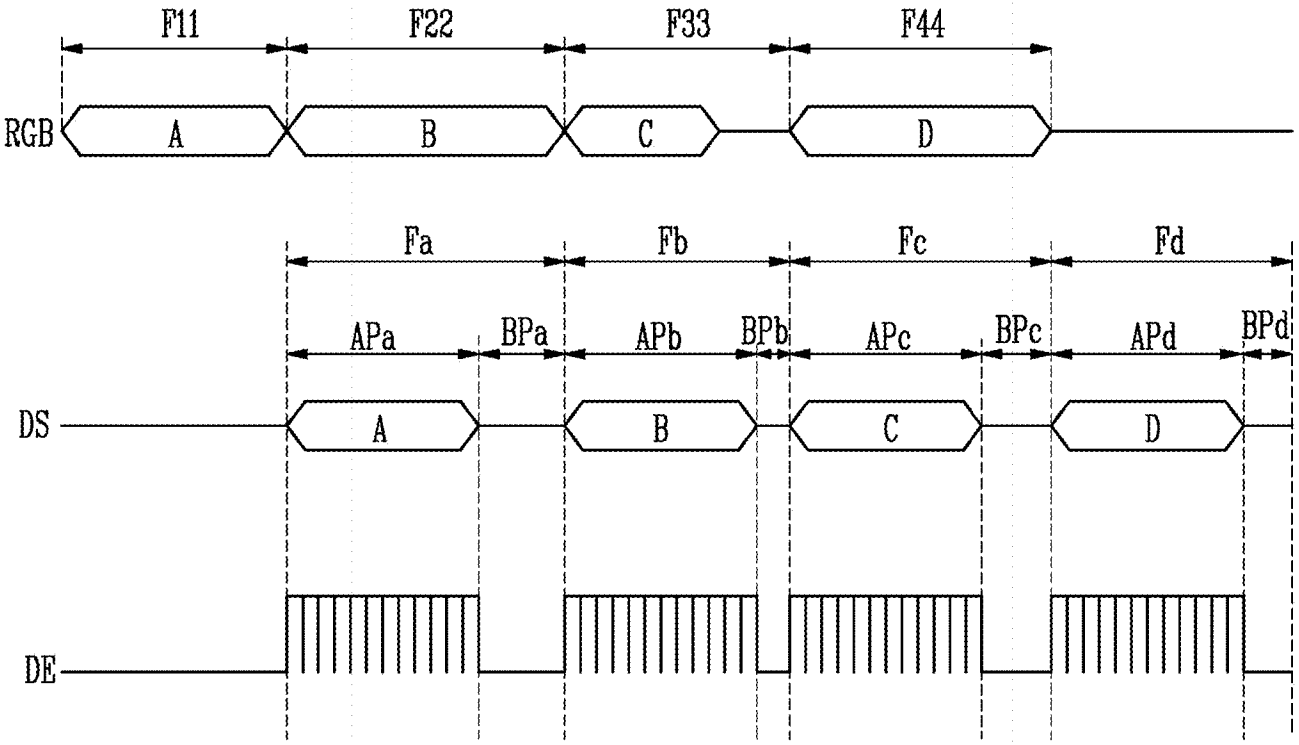
FIG. 4 is a diagram for explaining an example of driving of a display device depending on an image signal received from an external system.

FIG. 4 is a diagram for explaining an example of driving of a display device depending on an image signal received from an external system.

Referring to FIGS. 1 and 4, the image signal RGB received from the external system may be a signal rendered by a graphics processor or the like. The frame rate of the image signal RGB may vary depending on the rendering time of the graphics processor.

Hereinafter, the term "frame rate" may mean a frame frequency, that is, the number of frames transmitted per second (frame per second). As the frame rate is higher, the time length of one frame and the length of a blank period may be shorter, whereas as the frame rate is lower, the time length of one frame and the length of a blank period may be longer.

In an embodiment, when the frame rate of the image signal RGB varies depending on the rendering time of the graphics processor, the frame rate of the display device 1000 may also vary.

The image signal RGB may be signal-processed by the timing controller 400, and may then be delayed by one frame, after which the delayed image signal RGB may be output as a data signal DS (or a data voltage). In an embodiment, the data signal DS may be output in response to a data enable signal DE supplied from the timing controller 400.

The frame rate of the display device 1000 is identical to the frame rate of the externally received image signal RGB, which is delayed by one frame. For example, the frame rate of a frame Fa in which a data signal DS "A" of the display device 1000 is output may be identical to the frame rate of a frame F22 in which an image signal RGB "B" is received. The frame rate of a frame Fb in which a data signal DS "B" of the display device 1000 is output may be identical to the frame rate of a frame F33 in which an image signal RGB "C" is received.

One frame of the display device 1000 may include an active period during which the data signal DS is output and a blank period during which the data signal DS is not output. In an embodiment, the active period may include a scan period during which the data signal DS is supplied to the data lines DL1 to DLj and a display period during which pixels PX emit light in response to the data signal DS.

The time lengths of active periods APa, APb, APc, and APd during which data signals DS "A", "B", "C", and "D" are output in frames Fa, Fb, Fc, and Fd, respectively, may be identical to each other. In an embodiment, each of the active periods APa, APb, APc, and APd may include a scan period during which the data signal DS is written to the corresponding pixel PX.

The time lengths of the blank periods BPa, BPb, BPc, and BPd may vary depending on the frame rate of each of the frames Fa, Fb, Fc, and Fd and the difference between the active periods APa, APb, APc, and APd.

In an example illustrated in FIG. 4, because the frame rate of the frame Fa in which the data signal DS "A" is output is lower than the frame rate of the frame Fb in which the data signal DS "B" is output, the time length of the blank period BPa may be greater than the time length of the blank period BPb.

Even if the frame rate varies irregularly in this way, respective lengths of the blank periods BPa, BPb, BPc, and BPd in the frames Fa, Fb, Fc, and Fd may be controlled, and thus image tearing attributable to mismatch between frame generation by the graphics processor and frame output by the display device, an input lag in which a portion of an input frame disappears, etc. may be improved.

However, when the amount of deterioration of pixels is calculated, the actual amount of deterioration may not be reflected due to variation in a blank period depending on the variation in the frame rate. That is, when the amount of deterioration of pixels is calculated, the emission frequency of the pixels may be taken into consideration. In conventional technology, a scan start signal is counted so as to calculate the number of frames, and the count value is multiplied by the pixel emission time per frame, and thus the emission times of the pixels may be calculated. As a result, when frame rates are different from each other, it is limited in that the difference between the emission times of the pixels is reflected in the calculation of the amount of deterioration. Therefore, in the display device 1000 for which the frame rate varies, an image sticking compensation scheme that is capable of reflecting the actual amount of deterioration is desirable. Hereinafter, an improved image sticking compensation scheme will be described with reference to FIGS. 5 to 12.

Figure 5:
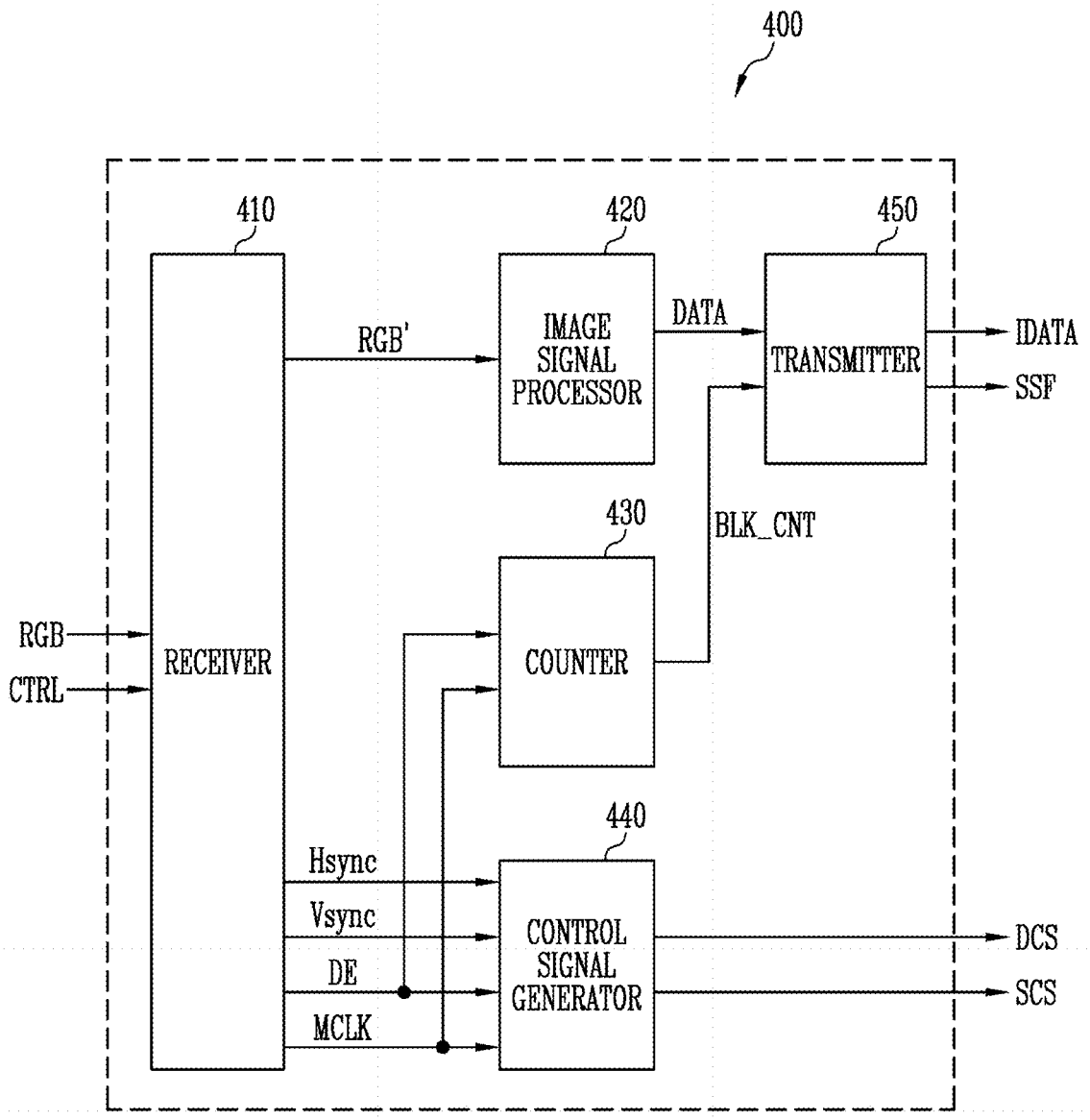
FIG. 5 is a block diagram illustrating the configuration of a timing controller according to an embodiment of the present disclosure.

FIG. 5 is a block diagram illustrating the configuration of a timing controller according to an embodiment of the present disclosure.

Referring to FIGS. 1 to 5, the timing controller 400 may include a receiver 410, an image signal processor 420, a counter 430, a control signal generator 440, and a transmitter 450.

The receiver 410 may supply an image signal RGB received from the external system, as an image signal RGB', to the image signal processor 420.

The receiver 410 may restore a data enable signal DE, having an active period APa, APb, APc, or APd and a blank period BPa, BPb, BPc, or BPd in each frame, in response to a control signal CTRL. The receiver 410 may further restore a horizontal synchronization signal Hsync, a vertical synchronization signal Vsync, and a main clock signal MCLK in response to the control signal CTRL.

The image signal processor 420 may convert the image signal RGB' received from the receiver 410 into image data DATA, and may output the image data DATA. For example, the image signal processor 420 may linearize the image signal RGB' so that the gamma characteristics of the image signal RGB' are in proportion to luminance, and may then output the image data DATA which is the linearized image signal.

The counter 430 may count a main clock signal MCLK during periods (or blank periods) in which the data enable signal DE is at a low level and in which data is not output, and may output a blank count signal BLK_CNT. Here, the blank count signal BLK_CNT may denote a value corresponding to the time length of the data enable signal DE.

The control signal generator 440 may receive the horizontal synchronization signal Hsync, the vertical synchronization signal Vsync, the data enable signal DE, and the main clock signal MCLK from the receiver 410, and may output a data driving control signal DCS including a source start signal, a clock signal, etc., and a scan driving control signal SCS including a scan start signal, a clock signal, etc. The data driving control signal DCS may be provided to the data driver 300 illustrated in FIG. 1, and the scan driving control signal SCS may be provided to the scan driver 100 illustrated in FIG. 1.

The transmitter 450 may output the image data DATA as input image data IDATA, and may output the blank count signal BLK_CNT as sensing frequency information SSF. The input image data IDATA and the sensing frequency information SSF may be provided to the image sticking compensator 500 illustrated in FIG. 1.

Figure 6:
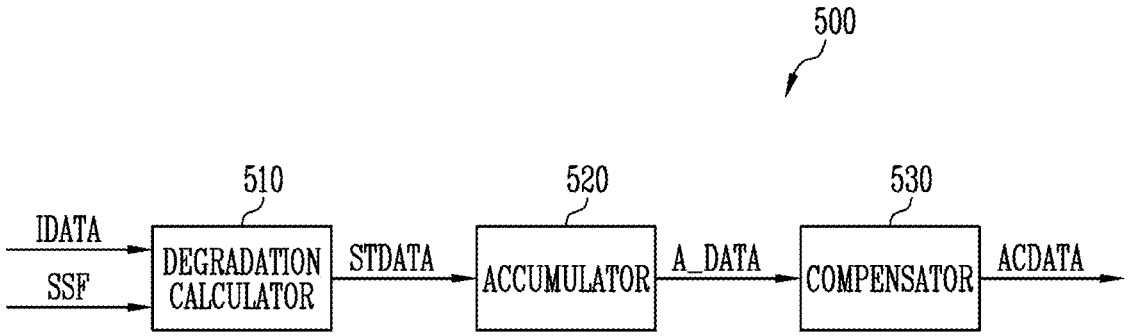
FIG. 6 is a block diagram illustrating an image sticking compensation device according to an embodiment of the present disclosure.
Figure 7:
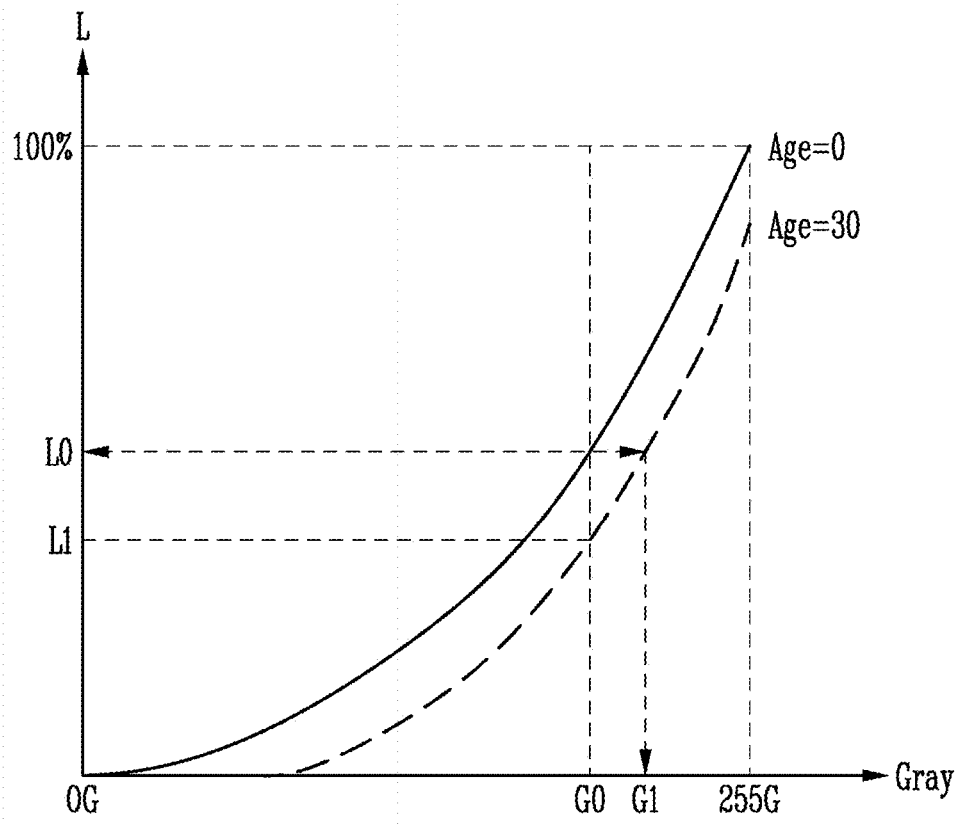
FIG. 7 is a graph illustrating an example in which the image sticking compensation device of FIG. 6 performs image sticking compensation.
Figure 8:
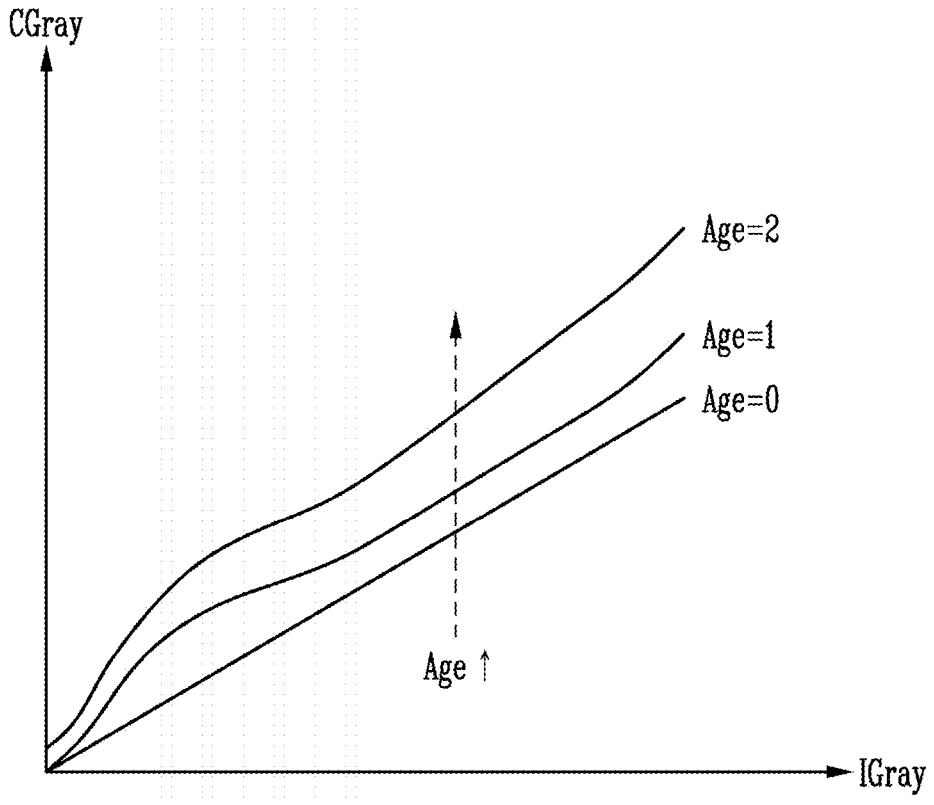
FIG. 8 is a graph illustrating an example of a relationship between input grayscale and output grayscale values depending on the accumulation of deterioration.
Figure 9:
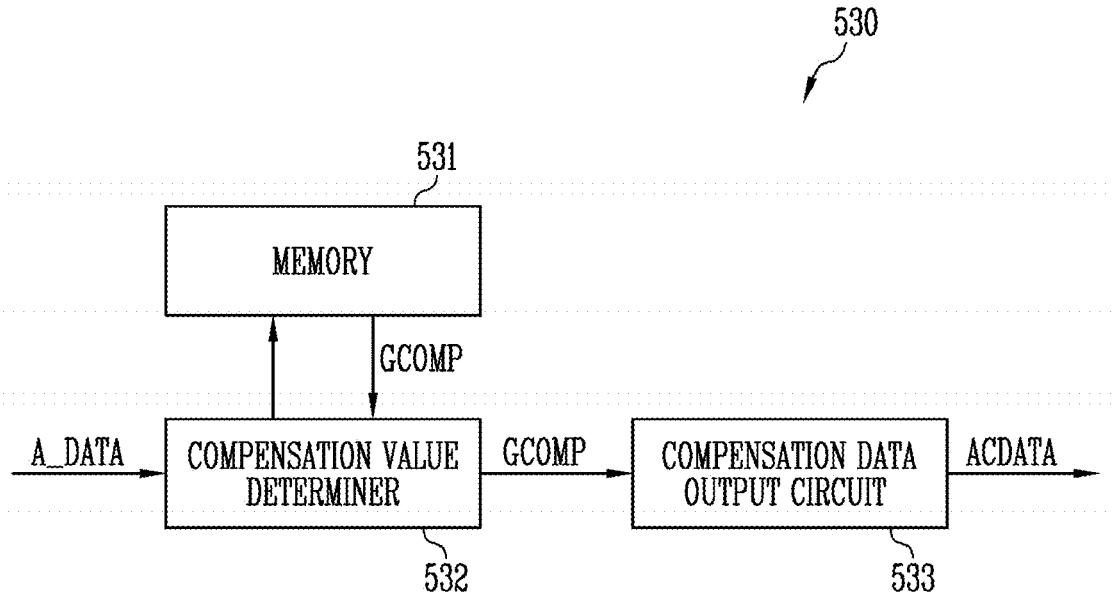
FIG. 9 is a block diagram illustrating an example of a compensator included in the image sticking compensation device of FIG. 6.

FIG. 6 is a block diagram illustrating an image sticking compensation device according to an embodiment of the present disclosure. FIG. 7 is a graph illustrating an example in which the image sticking compensation device of FIG. 6 performs image sticking compensation. FIG. 8 is a graph illustrating an example of a relationship between input grayscale and output grayscale values depending on the accumulation of deterioration. FIG. 9 is a block diagram illustrating an example of a compensator included in the image sticking compensation device of FIG. 6.

Referring to FIGS. 6 to 9, the image sticking compensator 500 may include a deterioration calculator 510, an accumulator 520, and a compensator 530. The image sticking compensator 500 may compensate for input image data IDATA so as to prevent image sticking (i.e., an afterimage) attributable to accumulation of deterioration.

FIG. 7 illustrates a relationship between grayscale and luminance depending on the accumulation of deterioration data or age data (i.e., depending on age). As illustrated in FIG. 7, when an input grayscale value corresponding to a first grayscale value GO is initially input (i.e., Age=0), a pixel may emit light with a first luminance L0. When deterioration of the pixel progresses (for example, when the curve in the graph is shifted from Age=0 to Age=30), the display luminance may be decreased to a second luminance L1 due to the input of the first grayscale value GO. Therefore, to emit light with the first luminance L0, the image sticking compensator 500 may correct the input grayscale value to the level of the second grayscale value Gl.

The deterioration calculator 510 (or degradation calculator) may calculate deterioration data STDATA of one frame (e.g., a current frame) based on the input image data IDATA and the sensing frequency information SSF. In the display device 1000 in which the frequency varies according to an embodiment of the present disclosure, a scheme for calculating deterioration data STDATA based on the emission frequency of the pixel will be described in detail later with reference to FIG. 11.

The deterioration calculator 510 may calculate a deterioration weight based on the condition of the display panel 200 or the like. The deterioration weight may be calculated based on at least one of the position of a corresponding pixel in the display panel 200, the magnitude of an input grayscale, the current temperature of the display panel 200, and the emission duty of the corresponding pixel. (See FIG. 12) The deterioration calculator 510 may provide the accumulator 520 with the deterioration data STDATA of the current frame (or previous frame) to which the deterioration weight is applied.

The accumulator 520 may accumulate the deterioration data STDATA and then generate age data A_DATA in which the deterioration data STDATA is accumulated. The age data A_DATA may include information about the age (lifetime) of each pixel (i.e., deterioration information). For example, the age information may include a plurality of age values identified as 10-bit data. As illustrated in FIG. 8, as the deterioration data STDATA is accumulated, the amount of deterioration may increase, and a count value for the age data A_DATA may increase (e.g., the count value increases in a sequence from AGE=0 to AGE=2). Therefore, as the deterioration of each pixel progresses, the magnitude of a correction grayscale CGRAY for displaying a predetermined input grayscale value IGRAY should be increased. The accumulator 520 may accumulate deterioration data STDATA in each frame, and may then update the age data A_DATA. In other words, the correction grayscale CGRAY may be a grayscale value that has been corrected to display a predetermined input grayscale value IGRAY at a specific age value corresponding to the age data A_DATA. The accumulator 520 may provide the age data A_DATA to the compensator 530.

The compensator 530 may determine a grayscale compensation value corresponding to the age data A_DATA. In an embodiment, the compensator 530 may calculate the grayscale compensation value using a lookup table scheme.

Referring to FIG. 9, the compensator 530 may include a memory 531, a compensation value determiner 532, and a compensation data output circuit 533.

The memory 531 may include a plurality of lookup tables in which compensation values, which correspond to a plurality of preset age values corresponding to the age data A_DATA and respective display grayscale values that can be implemented by the display panel 200, are set. One lookup table may include compensation values simultaneously corresponding both to respective age values and respective grayscale values. In an embodiment, the lookup tables may be classified depending on the colors of the pixels PX included in the display panel 200 and the preset temperature of the display panel 200. The memory 531 may include a static random access memory ("SRAM") or a dynamic random access memory ("DRAM") which stores the lookup tables.

The compensation value determiner 532 may determine grayscale compensation values GCOMP corresponding to the age data A_DATA using the lookup tables stored in the memory 531. In an embodiment, the compensation value determiner 532 may select one lookup table from among the lookup tables based on the current temperature of the display panel 200 and the colors of the pixels PX. The compensation value determiner 532 may determine a grayscale compensation value GCOMP corresponding to the age data A_DATA from the selected lookup table. Therefore, the grayscale compensation value GCOMP in which the emission color of the corresponding pixel, the degree of deterioration (aging), temperature, and a grayscale value desired to be displayed are reflected may be calculated.

The compensation data output circuit 533 may output age compensation data ACDATA using the grayscale compensation value GCOMP. Here, the age compensation data ACDATA may have a digital format defined as a grayscale domain. The age compensation data ACDATA may be converted into an analog format defined as a voltage domain to be provided to the display panel 200 through a separately provided gamma corrector.

Figure 10:
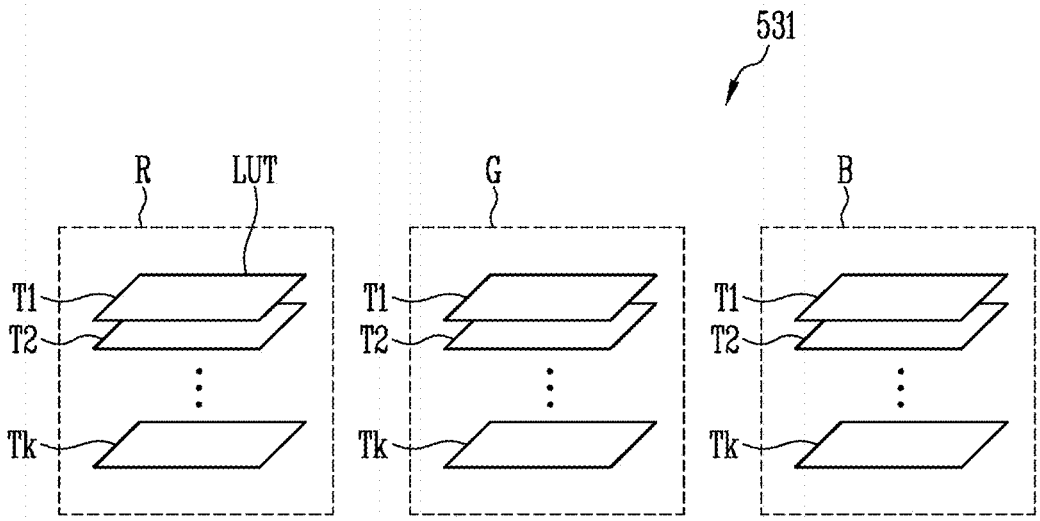
FIG. 10 is a block diagram illustrating an example of lookup tables included in the memory of FIG. 9.

FIG. 10 is a block diagram illustrating an example of lookup tables included in the memory of FIG. 9.

Referring to FIGS. 1, 9, and 10, the compensator 530 may determine a grayscale compensation value GCOMP using lookup tables.

In an embodiment, the memory 531 may include a plurality of lookup tables LUT. The lookup tables LUT may be set depending on the emission colors of the pixels PX and the temperature of the display panel 200, respectively. For example, the emission colors may be divided into red, green, and blue, and the lookup tables LUT may be classified into a first table group R to be applied to a red pixel, a second table group G to be applied to a green pixel, and a third table group B to be applied to a blue pixel. Furthermore, each of the first to third table groups R, G, and B may include a plurality of lookup tables LUT corresponding to preset temperatures, respectively. For example, each of the table groups R, G, and B may include lookup tables corresponding to first to k-th preset temperatures T1 to Tk, respectively. Each of the first to k-th preset temperatures T1 to Tk may include a specific temperature range or specific temperature values. In an embodiment, a grayscale compensation value GCOMP corresponding to a predetermined temperature may be calculated using interpolation between the lookup tables.

Figure 11:
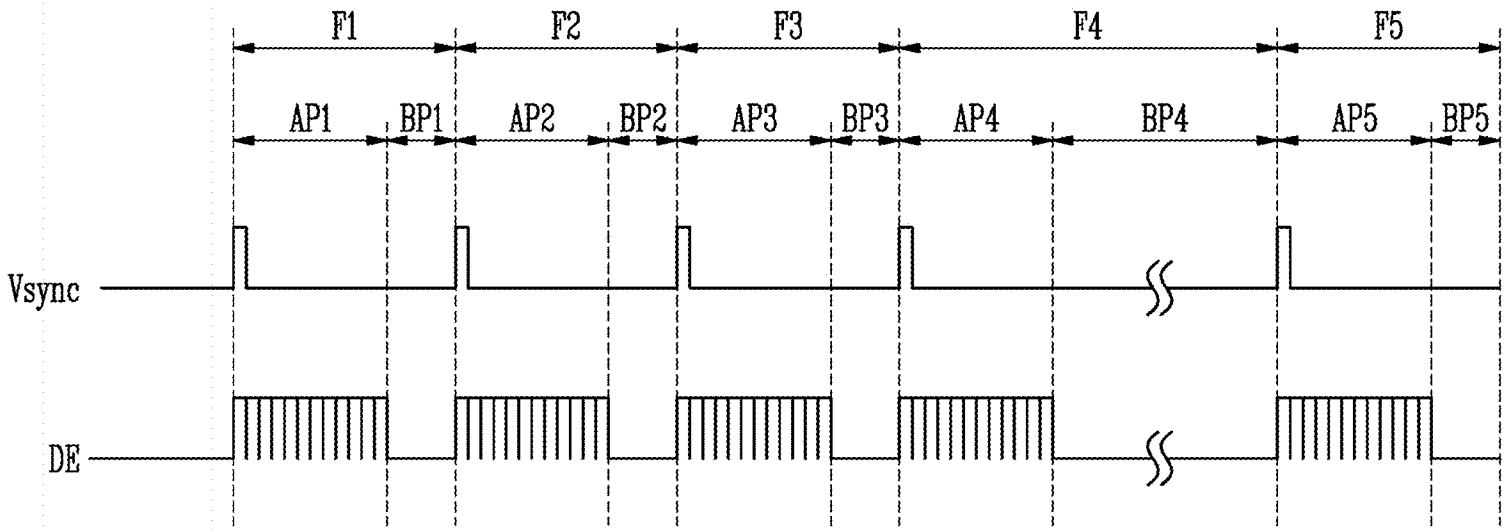
FIG. 11 is a diagram for explaining an image sticking compensation scheme for reflecting an actual emission time of a pixel during variable frequency driving.

FIG. 11 is a diagram for explaining an image sticking compensation scheme for reflecting an actual emission time of a pixel during variable frequency driving. Here, each of first to fifth frames F1, F2, F3, F4, and F5 may be divided into an active period AP1, AP2, AP3, AP4, or AP5 and a blank period BP1, BP2, BP3, BP4, or BP5.

Referring to FIG. 11, the first frame F1, the second frame F2, the third frame F3, and the fifth frame F5 may have the same frequency, and the fourth frame F4 may have a frequency different from that of the first to third frames F1, F2, and F3 and the fifth frame F5. For example, the frequency of the first frame F1, the second frame F2, the third frame F3, and the fifth frame F5 may be 120 Hertz (Hz), and the frequency of the fourth frame F4 may be 0.01 Hz.

The counter 430 illustrated in FIG. 5 may output a blank count signal BLK_CNT using a data enable signal DE and a main clock signal MCLK, which are received from the receiver 410. That is, the counter 430 may count the number of clock pulses of the main clock signal MCLK that is supplied during each of the blank periods BP1, BP2, BP3, BP4, and BP5, and may detect the time length of each of the blank periods BP1, BP2, BP3, BP4, and BP5. For example, the counter 430 may perform a count operation in synchronization with the main clock signal MCLK from a time point at which the data enable signal DE makes a transition to a low level. The counter 430 may repeat the count operation in synchronization with the main clock signal MCLK while the data enable signal DE is maintained at a low level. When the data enable signal DE makes a transition from a low level to a high level, the counter 430 may transmit the blank count signal BLK_CNT to the transmitter 450.

The transmitter 450 illustrated in FIG. 5 may output sensing frequency information SSF using the blank count signal BLK_CNT received from the counter 430. That is, the sensing frequency information SSF may include frequency information of the corresponding frame. For example, as the frequency is lower, the blank periods BP1, BP2, BP3, BP4, and BP5 may become longer, whereas as the frequency is higher, the blank periods BP1, BP2, BP3, BP4, and BP5 may become shorter.

The deterioration calculator 510 illustrated in FIG. 6 may output the deterioration data STDATA of the current frame using the input image data IDATA and the sensing frequency information SSF. The deterioration calculator 510 may calculate the deterioration data STDATA of the current frame using the following Equation (1):

$$\text{Deterioration data of current frame} = \text{reference age value} \times (\text{reference frequency})/(\text{sensing frequency}) \quad (1)$$

The reference frequency denotes the frequency used when the display device 1000 displays a basic image (i.e., normal image) in accordance with the input image data IDATA. That is, the reference frequency may refer to a frequency preset such that the reference frequency is used in normal frames other than a frame to which a variable frequency is applied due to sudden frame switching. The sensing frequency denotes the frequency of the current frame calculated by the timing controller 400. For example, in the embodiment illustrated in FIG. 11, when the reference frequency is 120 Hz, and the first frame F1, the second frame F2, the third frame F3, and the fifth frame F5 are current frames, the sensing frequency may be 120 Hz, whereas when the fourth frame F4 is the current frame, the sensing frequency may be 0.01 Hz.

The age values may be data indicating the degree of deterioration of each pixel in stages. For example, the age values may be data represented by 10 bits, and may be divided into levels ranging from 0 to 1023 depending on the degree of deterioration. In an embodiment, the reference age value may correspond to the time during which the pixel emits light during one frame driven at the reference frequency. For example, when the reference frequency is 120 Hz, the reference age value may be data corresponding to $1/120$=8.3 [milliseconds: ms].

Since the deterioration data STDATA of the current frame is calculated by multiplying a value, which is obtained by dividing the reference frequency by the sensing frequency, by the reference age value in the Equation (1), the deterioration data STDATA may have different values depending on the frequency of the current frame. For example, the deterioration data STDATA of the first frame F1 may be identical to the reference age value because the reference frequency is identical to the sensing frequency. That is, the deterioration data STDATA of the first frame F1 may be data corresponding to 8.3 [ms]. Similarly, the deterioration data STDATA of the second frame F2, the third frame F3, and the fifth frame F5 may also be identical to the reference age value because the reference frequency is identical to the sensing frequency. In contrast, the deterioration data STDATA of the fourth frame F4 may be a value obtained by multiplying 12000 by the reference age value because the reference frequency is 120 Hz and the sensing frequency is 0.01 Hz. That is, the deterioration data STDATA of the fourth frame F4 may be data corresponding to 100 [second: s].

Since the accumulator 520 illustrated in FIG. 6 outputs the age data A_DATA by accumulating deterioration data STDATA during the first to fifth frames F1 to F5, the age data A_DATA may be data corresponding to 8.3 [ms]*4+100[s]=100.0332 [s]. Because the image sticking compensator 500 may accumulates deterioration data STDATA for respective pixels by taking into consideration of the emission times or the like of the pixels that have changed according to the variable frequency, the amount of deterioration may be precisely calculated, thus greatly improving the precision of compensation for image sticking.**

In contrast, the conventional image sticking compensation device takes into consideration the frequency upon calculating the deterioration data STDATA, but it uses a scheme for counting a scan start signal when the frequency is calculated. The number of vertical synchronization signals Vsync illustrated in FIG. 11 is equal to the number of scan start signals that are signals starting one frame illustrated in FIG. 11, and thus five frames may be counted by the conventional scheme. Therefore, the deterioration data STDATA may be calculated by simply multiplying the number of frames (i.e., 5) by the reference age value (i.e., 8.3 [ms]) corresponding to a preset frequency (i.e., 120 Hz). That is, the age data A_DATA that is calculated by the conventional image sticking compensation device may be data corresponding to 8.3 [ms]*5=41.5 [ms]. In this way, it can be seen that the age data A_DATA calculated by the conventional scheme has a great difference from the age data A_DATA calculated by the image sticking compensator 500 according to the present disclosure in consideration of the actual emission time of the pixel PX.

Figure 12:
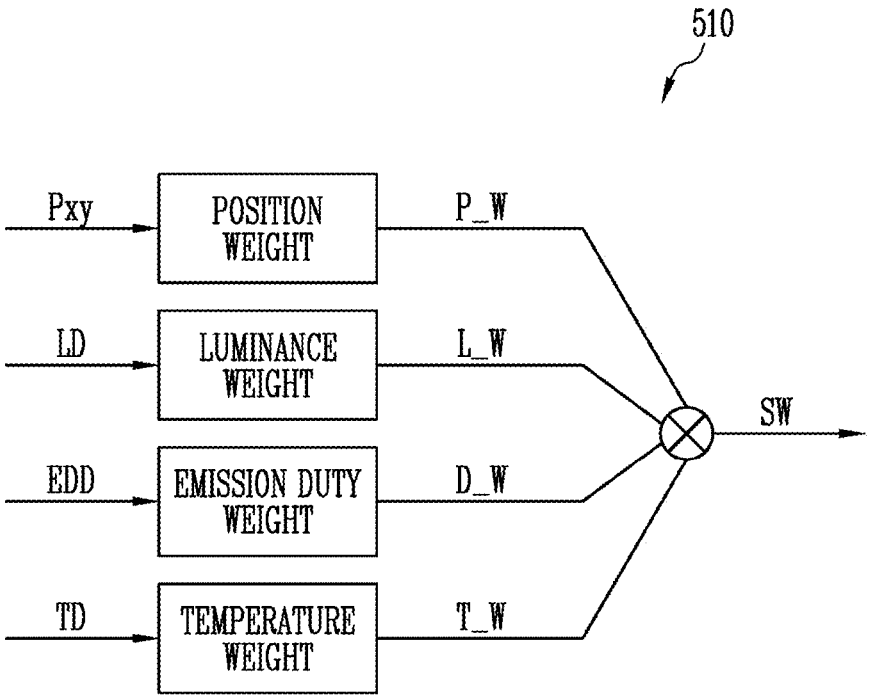
FIG. 12 is a diagram illustrating an example of a deterioration calculator included in the image sticking compensation device of FIG. 6.

FIG. 12 is a diagram illustrating an example of the deterioration calculator included in the image sticking compensation device of FIG. 6.

Referring to FIG. 12, the deterioration calculator 510 may calculate a deterioration weight SW based on input image data IDATA.

The input image data IDATA may include information about the position Pxy of each pixel, luminance LD, and an emission duty EDD. Furthermore, the deterioration calculator 510 may further receive the current temperature data TD of the display panel 200 through an algorithm which predicts the temperature using a current for each position of the display panel 200. The current temperature data TD of the display panel 200 may also be provided from an external temperature detector.

The deterioration calculator 510 may calculate at least one of a position weight P_W corresponding to the position Pxy of the pixel, a luminance weight L_W corresponding to the luminance LD, an emission duty weight D_W corresponding to the emission duty EDD, and a temperature weight T_W corresponding to the current temperature TD of the display panel 200. In other words, the deterioration weight SW may include at least one of the position weight P_W, the luminance weight L_W, the emission duty weight D_W, and the temperature weight T_W. The deterioration calculator 510 may calculate deterioration data STDATA of one frame using the deterioration weight SW.

In this way, because the image sticking compensator 500 according to the embodiments of the present disclosure accumulates deterioration data STDATA for each pixel PX in consideration of characteristics for respective positions in the display panel 200, conditions such as the temperature, etc., the amount of deterioration may be more precisely calculated.

An image sticking compensation device and a display device according to embodiments of the present disclosure may reflect an actual emission time of a pixel by counting blank periods, thus compensating for the deterioration degree of the pixel.

The effects of the present disclosure are not limited by the foregoing, and other various effects are anticipated herein.

Although the embodiments of the present disclosure have been described, those skilled in the art will appreciate that the present disclosure may be modified and changed in various forms without departing from the spirit and scope of the present disclosure as claimed in the accompanying claims.

What is claimed is:

1. An image sticking compensation device, comprising:

a deterioration calculator which calculates deterioration data of a current frame based on input image data and sensing frequency information which are received from a timing controller;

an accumulator which accumulates the deterioration data and generates age data in which the deterioration data is accumulated; and a compensator which determines a grayscale compensation value corresponding to the age data and an input grayscale value of the input image data, and outputs age compensation data by applying the grayscale compensation value to the input image data, wherein the sensing frequency information includes a frequency of the current frame, and wherein the deterioration data varies in accordance with the frequency of the current frame, wherein the deterioration calculator calculates the deterioration data using following Equation (1):

deterioration data of current frame=reference age value× (reference frequency)/(sensing frequency)

wherein the reference frequency is a frequency in normal frames other than a frame to which a variable frequency is applied, the reference age value is a value corresponding to a time during which a pixel emits light during one frame driven at the reference frequency, and the sensing frequency is a frequency of the current frame.

2. The image sticking compensation device according to claim 1, wherein the timing controller comprises:

a receiver which receives an image signal and a control signal from an external system and restores a data enable signal and a main clock signal from the control signal; and an image signal processor which converts the image signal into image data and outputs the image data.

3. The image sticking compensation device according to claim 2, wherein the timing controller further comprises:

a counter which outputs a blank count signal using the data enable signal and the main clock signal; and a transmitter which outputs the input image data using the image data and outputs the sensing frequency information using the blank count signal.

4. The image sticking compensation device according to claim 3, wherein the counter is configured to perform a count operation in synchronization with the main clock signal from a time point at which the data enable signal makes a transition to a low level, to repeat the count operation in synchronization with the main clock signal while the data enable signal is maintained at the low level, and to transmit the blank count signal to the transmitter when the data enable signal makes a transition from the low level to a high level.

5. The image sticking compensation device according to claim 1, wherein the compensator comprises:

a memory including a plurality of lookup tables in which compensation values, which correspond to a plurality of preset age values corresponding to the age data and respective display grayscale values that are capable of being implemented by a display panel, are set;

a compensation value determiner which determines the grayscale compensation value corresponding to the age data from the lookup tables; and a compensation data output circuit which outputs the age compensation data based on the grayscale compensation value.

6. The image sticking compensation device according to claim 5, wherein the lookup tables are set depending on an emission color of pixels included in the display panel and a preset temperature of the display panel, respectively.

7. The image sticking compensation device according to claim 6, wherein the compensation value determiner selects one lookup table from among the lookup tables based on a current temperature of the display panel and the emission color.

8. The image sticking compensation device according to claim 1, wherein the deterioration calculator calculates the deterioration data by applying a deterioration weight.

9. The image sticking compensation device according to claim 8, wherein the deterioration weight includes at least one of a position weight corresponding to a position of each pixel included in the display panel, a luminance weight corresponding to a luminance, an emission duty weight corresponding to an emission duty, and a temperature weight corresponding to a current temperature of the display panel.

10. The image sticking compensation device according to claim 9, wherein the deterioration calculator calculates the position weight, the luminance weight, and the emission duty weight based on the input image data.

11. The image sticking compensation device according to claim 9, wherein the deterioration calculator calculates the temperature weight based on an external temperature detector or a temperature prediction algorithm.

12. A display device, comprising:

a display panel including a plurality of pixels;

an image sticking compensator which outputs age compensation data based on input image data and sensing frequency information;

a scan driver which provides a scan signal to the display panel;

a data driver which provides a data signal corresponding to the age compensation data to the display panel; and a timing controller which controls driving of the scan driver and the data driver, wherein the image sticking compensator comprises:

a deterioration calculator which calculates deterioration data of a current frame based on the input image data and the sensing frequency information which are received from the timing controller;

an accumulator which accumulates the deterioration data and generates age data in which the deterioration data is accumulated; and a compensator which determines a grayscale compensation value corresponding to the age data and an input grayscale value of the input image data, and outputs the age compensation data by applying the grayscale compensation value to the input image data, wherein the sensing frequency information includes a frequency of the current frame, and wherein the deterioration data varies in accordance with the frequency of the current frame, wherein the deterioration calculator calculates the deterioration data using following Equation (1):

$$\text{deterioration data of current frame} = \text{reference age value} \times (\text{reference frequency}/(\text{sensing frequency}) \quad (1)$$

wherein the reference frequency is a frequency in normal frames other than a frame to which a variable frequency is applied, the reference value is a value corresponding to a time during which a pixel emits light during one frame driven at the reference frequency, and the sensing frequency is a frequency of the current frame.

13. The display device according to claim 12, wherein the timing controller comprises:

a receiver which receives an image signal and a control signal from an external system and restores a data enable signal and a main clock signal from the control signal; and an image signal processor which converts the image signal into a data signal and outputs the data signal.

14. The display device according to claim 13, wherein the timing controller further comprises:

a counter which outputs a blank count signal using the data enable signal and the main clock signal; and a transmitter which outputs the input image data using the data signal and outputs the sensing frequency information using the blank count signal.

15. The display device according to claim 14, wherein the counter is configured to perform a count operation in synchronization with the main clock signal from a time point at which the data enable signal makes a transition to a low level, to repeat the count operation in synchronization with the main clock signal while the data enable signal is maintained at the low level, and to transmit the blank count signal to the transmitter when the data enable signal makes a transition from the low level to a high level.

16. The display device according to claim 12, wherein the compensator comprises:

a memory including a plurality of lookup tables in which compensation values, which correspond to a plurality of preset age values corresponding to the age data and respective display grayscale values that are capable of being implemented by a display panel, are set;

a compensation value determiner which determines the grayscale compensation value corresponding to the age data from the lookup tables; and a compensation data output circuit which outputs the age compensation data based on the grayscale compensation value.

17. The display device according to claim 16, wherein the lookup tables are set depending on an emission color of pixels included in the display panel and a preset temperature of the display panel, respectively.

18. The display device according to claim 17, wherein the compensation value determiner selects one lookup table from among the lookup tables based on a current temperature of the display panel and the emission color.

* * * * *